US008131177B2

(12) United States Patent
Murao

(10) Patent No.: US 8,131,177 B2
(45) Date of Patent: Mar. 6, 2012

(54) IMAGE FORMING APPARATUS

(75) Inventor: Hidetoshi Murao, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 446 days.

(21) Appl. No.: 12/388,768

(22) Filed: Feb. 19, 2009

(65) Prior Publication Data

US 2009/0214253 A1 Aug. 27, 2009

Related U.S. Application Data

(60) Provisional application No. 61/030,911, filed on Feb. 22, 2008.

(51) Int. Cl.
*G03G 15/16* (2006.01)
*G03G 15/00* (2006.01)
*G03G 21/00* (2006.01)

(52) U.S. Cl. ..... 399/101; 399/107; 399/346

(58) Field of Classification Search ..... 399/101, 399/107, 313, 346
See application file for complete search history.

(56) References Cited

U.S. PATENT DOCUMENTS 7,254,364 B2 * 8/2007 Nakayama ..... 399/345
7,373,101 B2 * 5/2008 Hozumi et al. ..... 399/346
7,448,610 B2 * 11/2008 Ito et al. ..... 271/109
2007/0172273 A1 * 7/2007 Harada et al. ..... 399/346
2008/0298864 A1 12/2008 Murao
2009/0214252 A1 * 8/2009 Murao ..... 399/101

FOREIGN PATENT DOCUMENTS

JP P2005-173449 6/2005
JP P2006-106467 4/2006
JP P2007-264546 10/2007
JP P2008-040056 2/2008

OTHER PUBLICATIONS

U.S. Appl. No. 12/208,153, filed Sep. 10, 2008, Murao.

* cited by examiner

*Primary Examiner* — David Gray
*Assistant Examiner* — Frederick Wenderoth
(74) *Attorney, Agent, or Firm* — Patterson & Sheridan, LLP

(57) ABSTRACT

An image forming apparatus includes a secondary transfer roller that is supported by a secondary-transfer-unit supporting unit and transfers a toner image onto a recording medium, a lubricant applying brush that comes into contact with the secondary transfer roller and applies a lubricant to the secondary transfer roller, a solid lubricant that is housed in a lubricant-applying-brush housing unit and supplies the lubricant to the lubricant applying brush, and a lubricant holding member that elastically holds the solid lubricant. The lubricant is supplied to the secondary transfer roller according to a material of the lubricant, a pressing amount of the lubricant against the secondary transfer roller, a configuration of the secondary transfer roller, a configuration of the fur brush, and a relation among fur brush circumferential speed, secondary transfer roller circumferential speed, a pressing amount of a blade against the secondary transfer roller, and a blade material.

17 Claims, 9 Drawing Sheets

IMAGE FORMING APPARATUS

CROSS-REFERENCE TO RELATED APPLICATION

This application is based upon and claims the benefit of U.S. Provisional Application 61/030,911, filed Feb. 22, 2008.

TECHNICAL FIELD

The present invention relates to an image forming apparatus in which, in a secondary transfer unit having a mechanism for bringing a secondary transfer roller into contact with and separating the secondary transfer roller from an image bearing member, a lubricant unit including a lubricant applying brush, a lubricant assembly, and a driving gear is incorporated as a replacement part.

BACKGROUND

An image forming apparatus includes an image transfer unit that transfers a reversal image based on a scanned document image onto an image bearing member as a toner image and a secondary transfer unit that comes into contact with the image bearing member and transfers the toner image onto a recording medium.

The secondary transfer unit includes a contact and separation mechanism for bringing a secondary transfer roller into contact with the image bearing member when the toner image is transferred onto a sheet and separating the secondary transfer roller from the image bearing member when the toner image is not transferred onto the sheet.

There is known a secondary transfer roller contact and separation driving apparatus in which, in a secondary transfer unit having a mechanism for bringing a secondary transfer roller into contact with and separating the secondary transfer roller from an image bearing member, the number of components of a mechanical unit configuring a mechanism for performing contact and separation operations is not increased and a device such as an electromagnetic clutch that requires electric control is not used (see JP-A-2007-264546).

On the other hand, there is known an image forming apparatus mounted with a mechanism for bringing a cleaning blade into contact with a secondary transfer roller and cleaning the secondary transfer roller in order to scrape off a toner on the secondary transfer roller. Further, there is known a mechanism for applying a lubricant to the surface of a secondary transfer roller via a fur brush (a lubricant applying brush) in order to extend the durable life of the secondary transfer roller and prevent the cleaning blade from curling up. Solid zinc stearate is used as the lubricant. The zinc stearate is mounted on a holding member and pressed to the fur brush side by a spring. The holding member is formed of a member having high rigidity such as a sheet metal and is integrated with the zinc stearate to configure a lubricant assembly.

When the lubricant is supplied in this way, if an application amount of the lubricant is excessive, it is likely that rear stain of a sheet occurs. If the application amount is too small, for example, the cleaning blade curls up and a load on the secondary transfer roller increases.

SUMMARY

According to an aspect of the present invention, there is provided an image forming apparatus including: an image transfer unit that transfers a reversal image based on a scanned document image onto an image bearing member as a toner image; a secondary-transfer-unit supporting unit; a secondary transfer roller that is supported by the secondary-transfer-unit supporting unit and comes into contact with the image bearing member and transfers the toner image onto a recording medium; a secondary-transfer-roller housing unit that houses the secondary transfer roller; a lubricant applying brush that comes into contact with the secondary transfer roller and applies a lubricant to the secondary transfer roller; a lubricant-applying-brush housing unit that houses the lubricant applying brush; a solid lubricant that is housed in the lubricant-applying-brush housing unit and supplies the lubricant to the lubricant applying brush; and a lubricant holding member that elastically holds the solid lubricant. A proper amount of the lubricant is supplied to the secondary transfer roller according to a material of the lubricant, a pressing amount of the lubricant against the secondary transfer roller, a configuration of the secondary transfer roller, a configuration of the fur brush, and a relation among fur brush circumferential speed, secondary transfer roller circumferential speed, a pressing amount of a blade against the secondary transfer roller, and a blade material.

DETAILED DESCRIPTION

Figure 1:
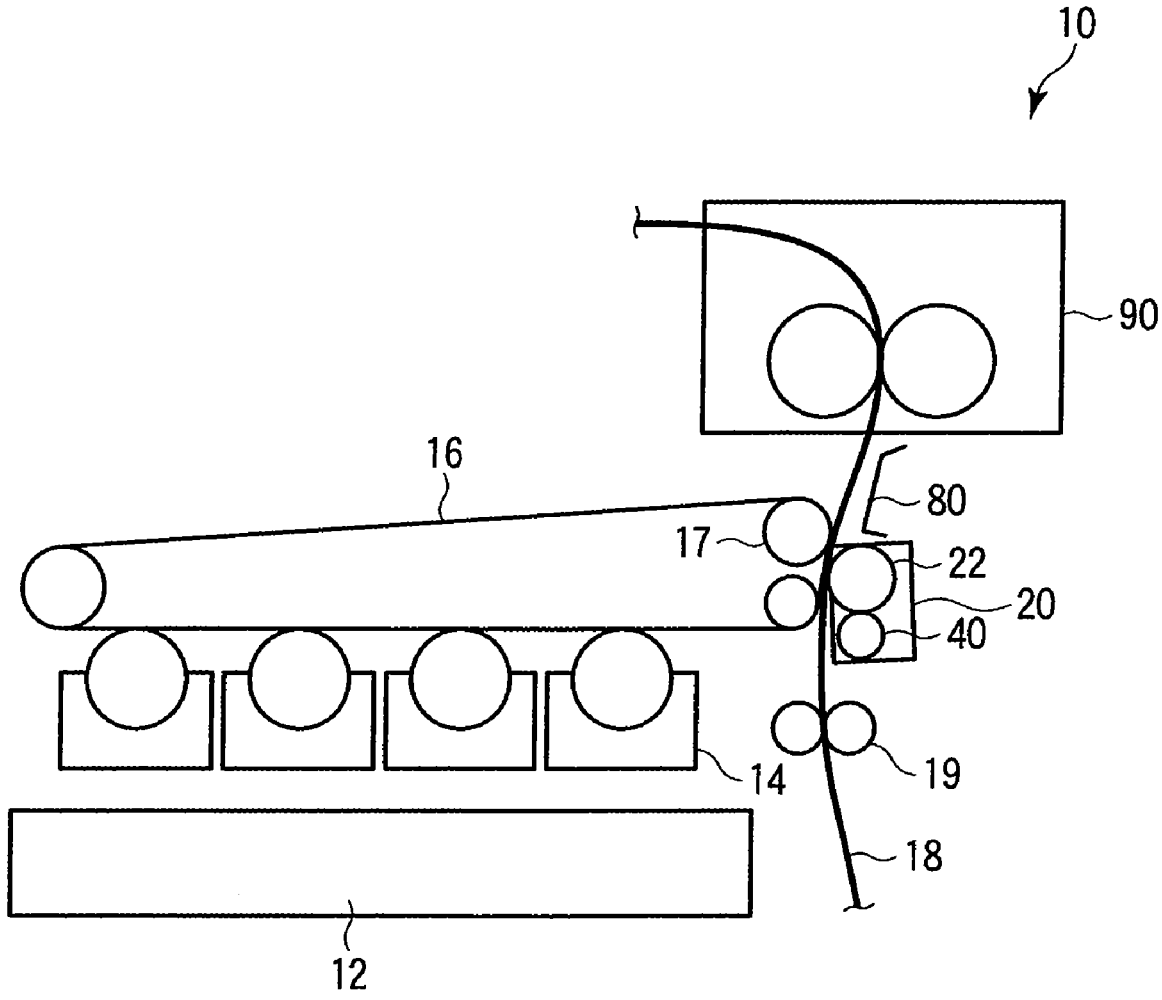
FIG. 1 is a schematic diagram of an image forming unit of an image forming apparatus according to a first embodiment of the present invention.
Figure 2:
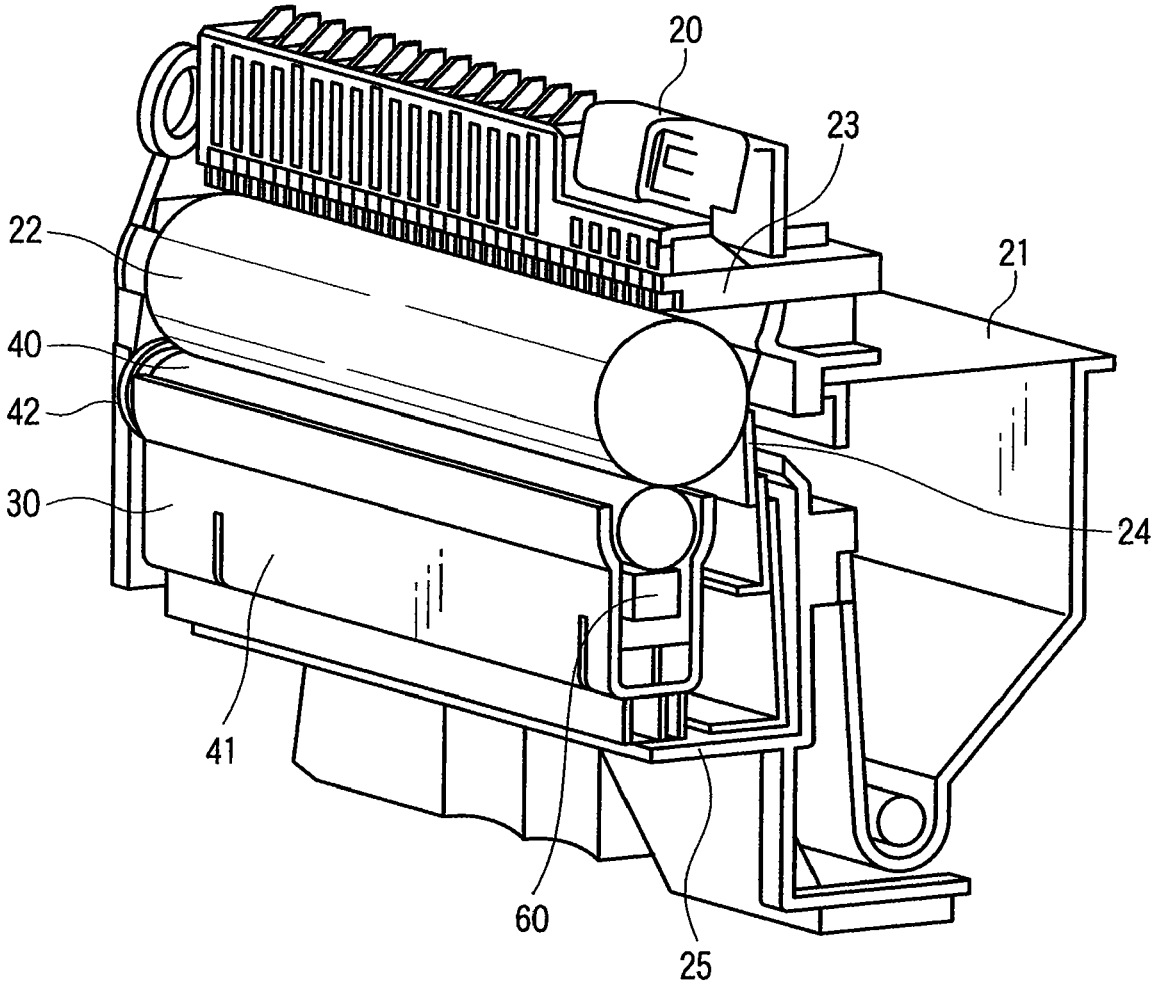
FIG. 2 is a perspective view of a configuration of a secondary transfer unit incorporated in the image forming unit.
Figure 3:
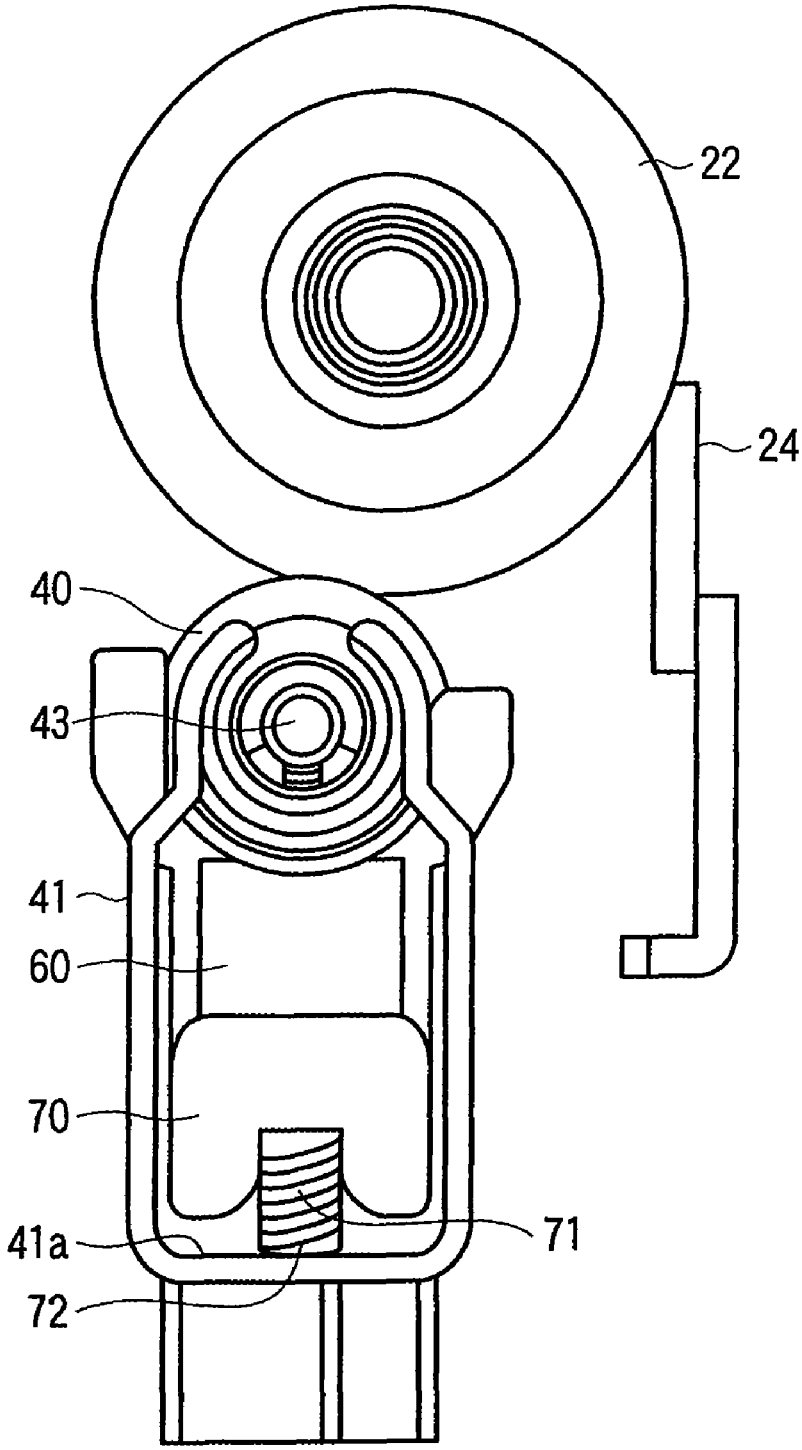
FIG. 3 is a side view of a main part of the secondary transfer unit.
Figure 4:
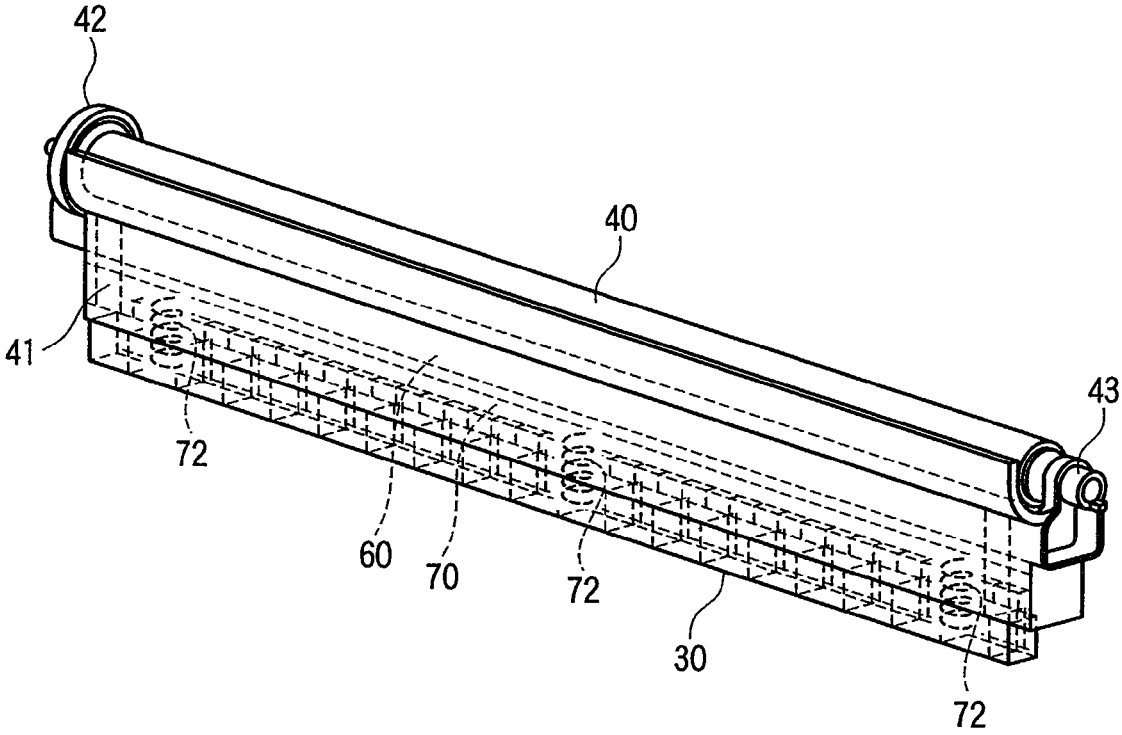
FIG. 4 is a perspective view of a lubricant unit incorporated in the secondary transfer unit.

FIG. 1 is a schematic diagram of an image forming unit 10 of an image forming apparatus according to a first embodiment of the present invention. FIG. 2 is a perspective view of a configuration of a secondary transfer unit 20. FIG. 3 is a side view of a main part of the secondary transfer unit 20. FIG. 4 is a perspective view of a lubricant unit 30.

As shown in FIG. 1, the image forming unit 10 includes a laser unit 12, developing devices 14, a transfer belt (an image bearing member) 16, a counter roller 17, a sheet conveying path 18, registration rollers 19, a secondary transfer unit 20, a conveyance guide 80, and a fixing device 90.

A laser unit 12 performs exposure using a laser beam optically modulated according to an image signal of an original document scanned by a not-shown scanner unit or an image signal input from an external apparatus and forms electrostatic latent images on the developing devices 14. The developing devices 14 reversely develop the electrostatic latent images and transfer toner images onto the transfer belt 16.

The sheet conveying path 18 is a conveying path for a sheet (a recording medium) fed from a not-shown sheet feeding unit. The registration rollers 19 correct a tilt of the sheet right before an image is transferred thereon. A secondary transfer roller 22 is arranged downstream of the registration rollers 19 to be opposed to the counter roller 17 and capable of coming into contact with the transfer belt 16. When the sheet passes between the transfer belt 16 and the secondary transfer roller 22, the toner images are collectively transferred onto the sheet. The conveyance guide 80 guides the sheet conveyed out from the secondary transfer roller 22 to the fixing device 90. The fixing device 90 fixes the image transferred by the secondary transfer roller 22 on the sheet.

Reference numeral 20 in FIG. 2 denotes the secondary transfer unit. The secondary transfer unit 20 includes a secondary-transfer-unit supporting unit 21. The secondary-transfer-unit supporting unit 21 includes a secondary transfer roller 22 that comes into contact with an image bearing member and transfers a toner image onto a sheet and a secondary-transfer-roller housing unit 23 that houses the secondary transfer roller 22. The secondary-transfer-unit supporting unit 21 has a function of bringing the secondary transfer roller 22 into contact with and separating the secondary transfer roller 22 from the transfer belt 16. A cleaning blade 24 that scrapes off a residual toner adhering to the secondary transfer roller 22 is set in contact with the secondary transfer roller 22. A bracket 25 for detachably attaching a lubricant unit 30 is formed in the secondary-transfer-unit supporting unit 21.

In the lubricant unit 30, a fur brush 40, a lubricant case 41, a driving gear 42, a solid lubricant 60, a holding member 70, and a pressing spring 72 that presses the holding member 70 to the secondary transfer roller 22 side are integrally formed.

As shown in FIGS. 2 and 3, the fur brush 40 and the lubricant case (a lubricant holding member) 41 that is pressed against the fur brush 40 and supplies the lubricant (zinc stearate) 60 to the fur brush 40 are provided below the secondary transfer roller 22. The lubricant 60 is applied for the purpose of taking measures against curl-up of the cleaning blade 24 and extending the durable life of the secondary transfer roller 22.

A driving gear 42 is attached to a rotating shaft of the fur brush 40. The rotating shaft is supported by a shaft supporting bush 43. The driving gear 42 has a function of transmitting rotational force from the outside to the fur brush 40.

The solid lubricant 60 obtained by solidifying zinc stearate and the holding member 70 made of a resin material are housed in the lubricant case 41. The solid lubricant 60 is joined and integrated with the holding member 70 by a double-face tape or the like. A projection-like boss 71 is provided below a bottom surface of the holding member 70.

The holding member 70 is elastically attached to a bottom surface 41a of the lubricant case 41 via the pressing spring 72 arranged over a circumferential surface of the boss 71. The boss 71 has a function of preventing buckling of the pressing spring 72.

On the other hand, in order to properly maintain a supply amount of the lubricant, a configuration of the members and a relation among the members are set as explained below.

Figure 5:
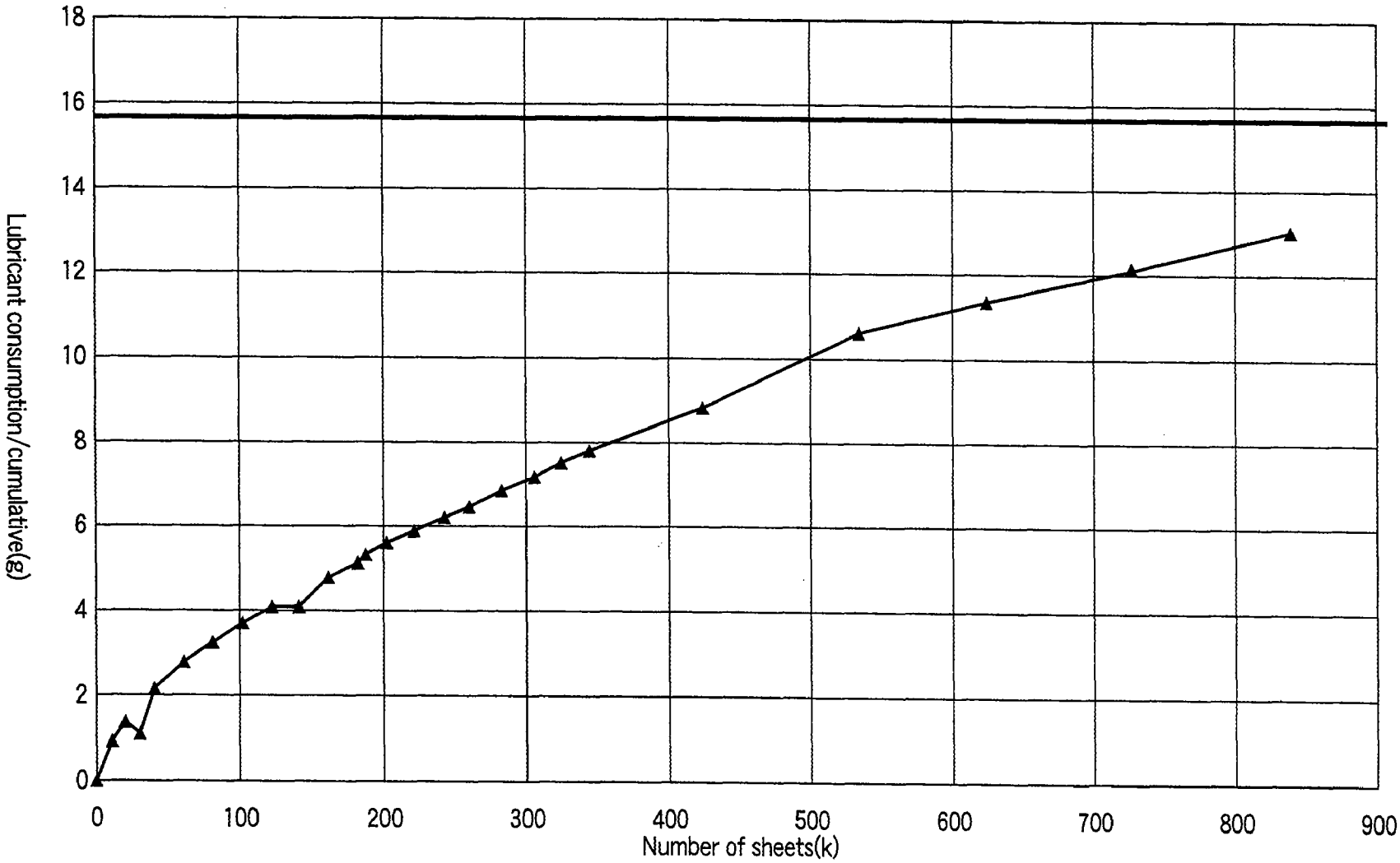
FIG. 5 is a graph of a relation between the durable life of a lubricant and a cumulative lubricant consumption in the secondary transfer unit.
Figure 6:
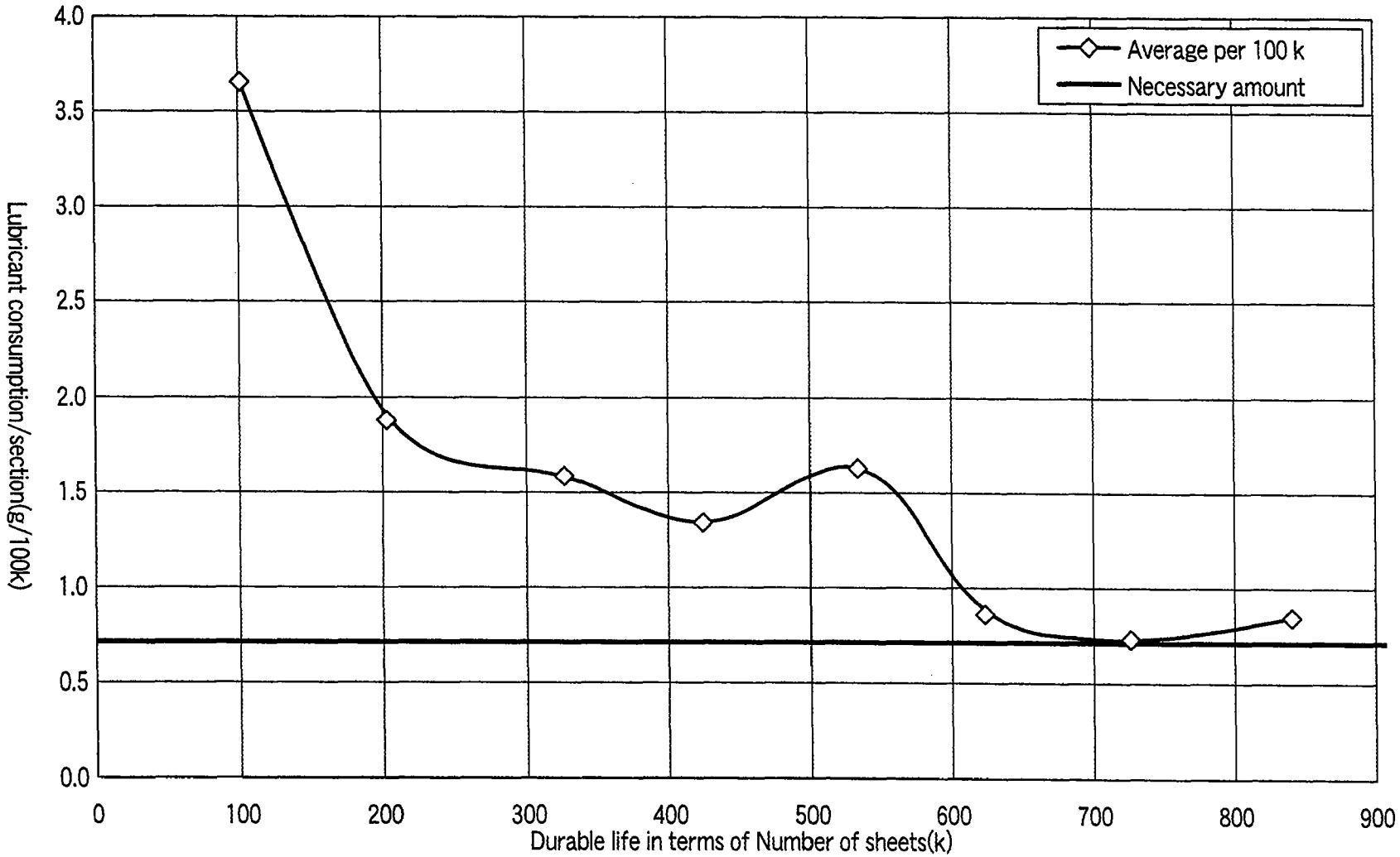
FIG. 6 is a graph of a relation between the durable life of a lubricant and a lubricant consumption per section in the secondary transfer unit.

A pressing amount of the solid lubricant 60 against the fur brush 40 is set to 85 g/mm to 135 g/mm. This pressing amount depends on a cumulative lubricant consumption and a lubricant consumption per section. FIG. 5 is a graph of a relation between the durable life of the lubricant and the cumulative lubricant consumption. The cumulative lubricant consumption is desirably equal to or smaller than 15.7 g, which is an index with respect to the durable life. On the other hand, FIG. 6 is a graph of a relation between the durable life of the lubricant, which is an index of performance with respect to cleaning performance, and the lubricant consumption per section (every 100 thousand sheets). The lubricant consumption per section is desirably equal to or bigger than 0.7 g. Since the pressing amount of 85 g/mm to 135 g/mm satisfies these conditions, the pressing amount is a proper pressing amount.

The secondary transfer roller 22 is obtained by covering nitrile-butadiene rubber (NBR) with a hydrin rubber tube and applying fluorine coating to the surface of the hydrin rubber tube. The secondary transfer roller 22 is formed at the hardness of 30 degrees to 40 degrees (in Asker C hardness) and the diameter of 28 mm.

The fur brush 40 is made of polyethylene terephthalate (PET) and has the thickness of 10 deniers, the density of 300,000 per square inch, and the maximum diameter of 14 mm.

A circumferential speed ratio between the secondary transfer roller 22 and the fur brush 40 is 1:0.46. A cut-in amount of the fur brush 40 into the secondary transfer roller 22 is 0.6 mm. A pressing amount of the cleaning blade 24 against the secondary transfer roller 22 is 1.1 g/mm to 1.5 g/mm. The cleaning blade 24 is made of thermoplastic polyurethane and has the hardness of 70 degrees (in JIS-A hardness).

The proper pressing amount is set as explained below.

Figure 7:
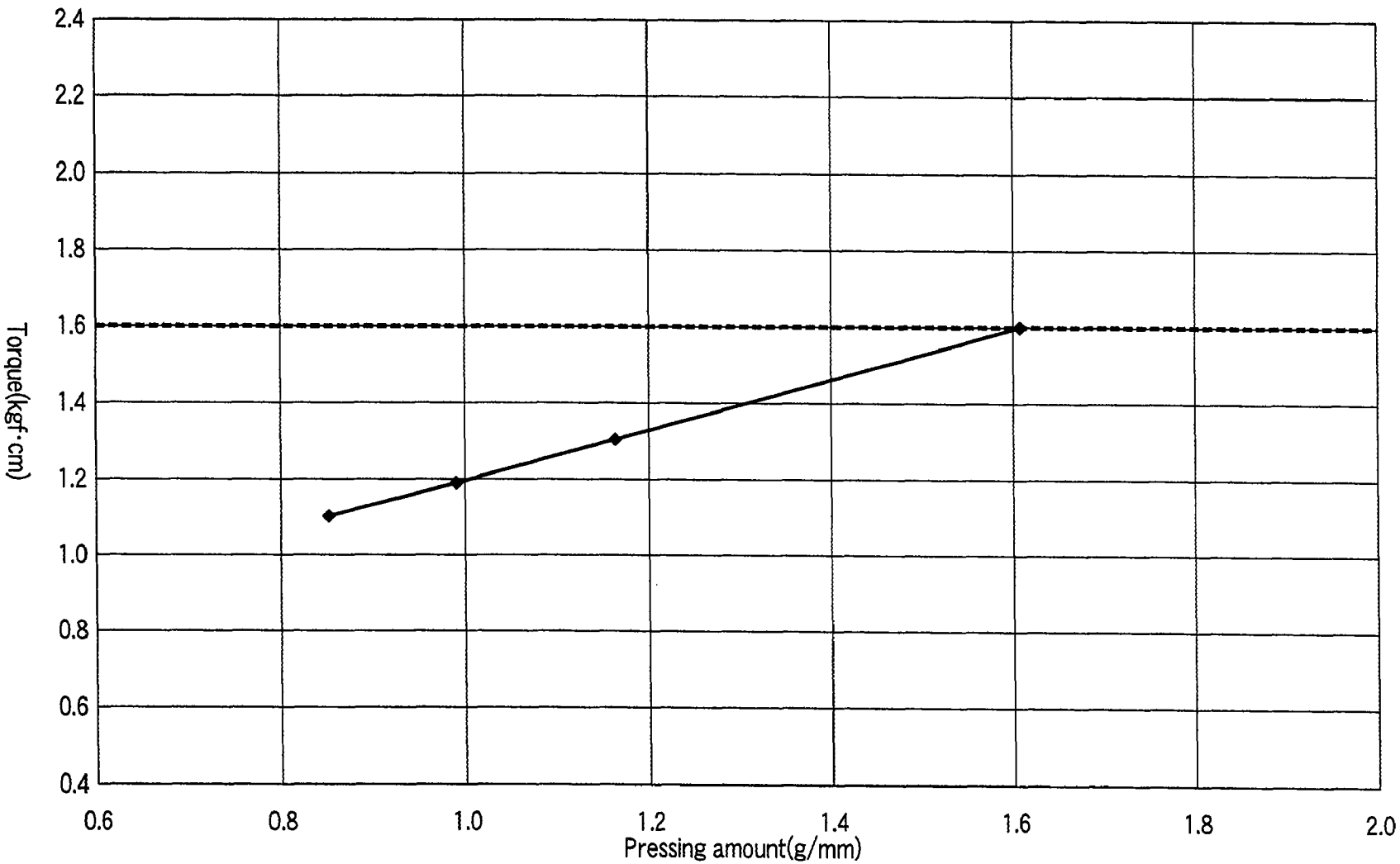
FIG. 7 is a graph of a relation between linear pressure and torque in the secondary transfer unit.
Figure 8:
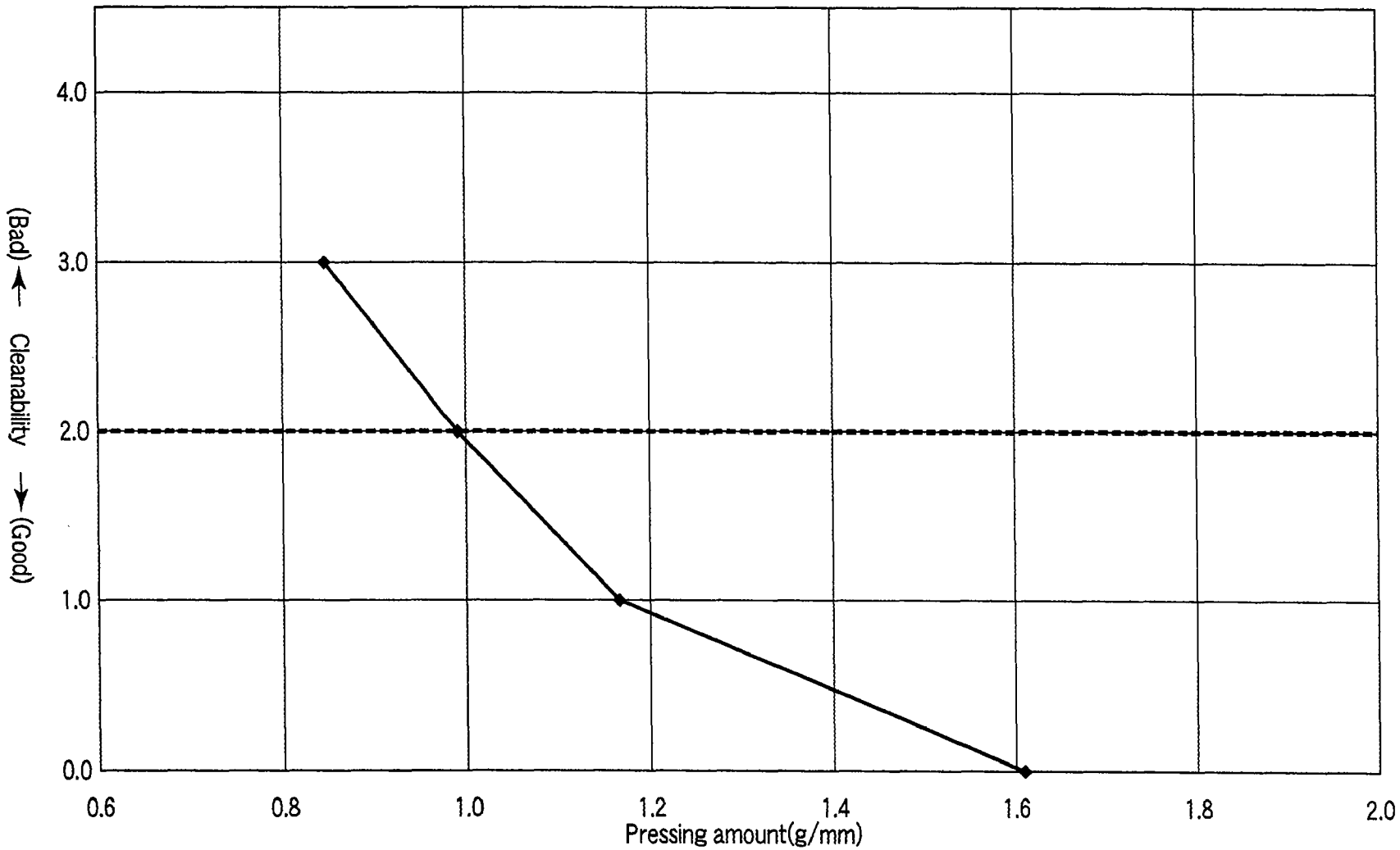
FIG. 8 is a graph of a relation between linear pressure and cleanability in the secondary transfer unit.

A torque applied to the secondary transfer roller 22 is desirably set to be equal to or smaller than 1.6 kgf·cm. Therefore, as shown in FIG. 7, according to a relation between the pressing amount of the cleaning blade 24 against the secondary transfer roller 22 and the torque applied to the secondary transfer roller 22, the pressing amount is desirably equal to or smaller than 1.5 g/mm. On the other hand, in order to secure cleanability, the cleanability is desirable equal to or smaller than 2. Therefore, as shown in FIG. 8, according to a relation between the pressing amount and the cleanability in the secondary transfer roller 22, the pressing amount is desirably equal to or larger than 1.1 g/mm. Therefore, the pressing amount of the cleaning blade 24 against the secondary transfer roller 22 is set to 1.1 g/mm to 1.5 g/mm.

According to the embodiment explained above, an appropriate coating amount of the lubricant can be supplied to the secondary transfer roller 22. Therefore, it is possible to prevent occurrence of rear stain of a sheet and also prevent curl-up of the cleaning blade 24 and an increase in load on the secondary transfer roller 22. Since the members can be procured at low cost, it is possible to manufacture the image forming apparatus at low cost.

Figure 9:
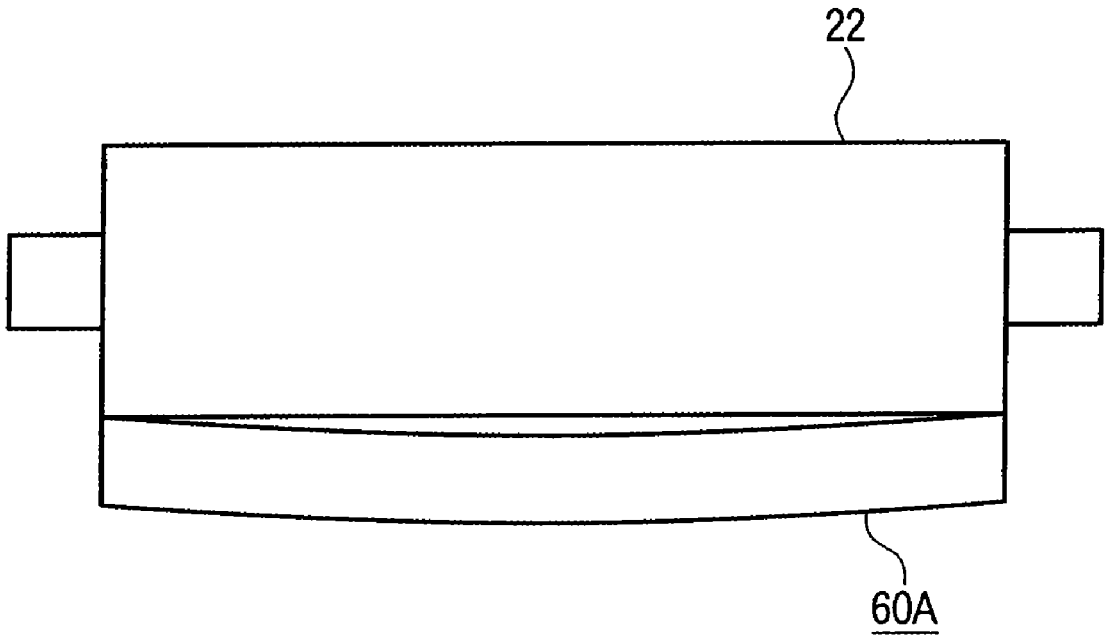
FIG. 9 is a schematic front view of a secondary transfer roller and a solid lubricant incorporated in an image forming apparatus according to a second embodiment of the present invention.

FIG. 9 is a front view of the secondary transfer roller 22 and a solid lubricant 60A of an image forming apparatus according to a second embodiment of the present invention.

The lubricant 60A is formed to be further spaced apart from the secondary transfer roller 22 in the center than on both end sides in an axial direction of the secondary transfer roller 22. Therefore, the lubricant 60A can be pressed harder on both end sides than in the center of the secondary transfer roller 22 to supply a larger amount of lubricant to both the end sides. The cleaning blade 24 tends to easily curl up on both the end sides of the secondary transfer roller 22. Therefore, it is desirable to supply a larger amount of lubricant to both the end sides. Since the center is lubricated by a toner to some extent, the center does not curl up even if only a small amount of lubricant is supplied thereto.

Figure 10:
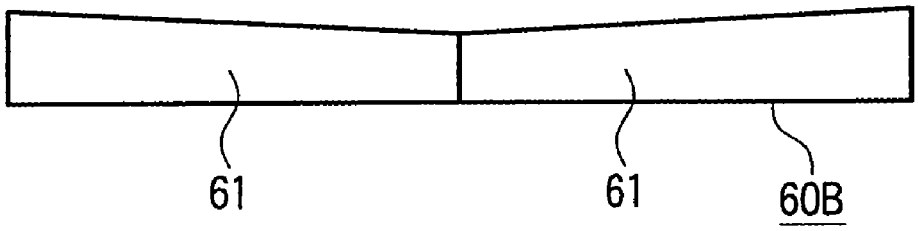
FIG. 10 is a schematic front view of a modification of the solid lubricant.

FIG. 10 is a front view of a solid lubricant 60B according to a modification of the solid lubricant 60A. Because of easiness of production of a lubricant, it is desirable to form the solid lubricant 60B by butting a pair of solid lubricants 61, 61 against each other in the center in the axial direction of the secondary transfer roller 22.

What is claimed is

1. An image forming apparatus comprising:

an image transfer unit that transfers a reversal image based on a scanned document image onto an image bearing member as a toner image;

a secondary-transfer-unit supporting unit;

a secondary transfer roller that is supported by the secondary-transfer-unit supporting unit and comes into contact with the image bearing member and transfers the toner image onto a recording medium;

a secondary-transfer-roller housing unit that houses the secondary transfer roller;

a lubricant applying brush that comes into contact with the secondary transfer roller and applies a lubricant to the secondary transfer roller, a pressing amount of the lubricant at a center of the second transfer roller in an axial direction being set lower than that at both end sides of the second transfer roller in the axial direction;

a lubricant-applying-brush housing unit that houses the lubricant applying brush;

a solid lubricant that is housed in the lubricant-applying-brush housing unit and supplies the lubricant to the lubricant applying brush; and a lubricant holding member that elastically holds the solid lubricant.

2. The apparatus according to claim 1, wherein the pressing amount of the lubricant against the fur brush is 85 g/mm to 135 g/mm, and the lubricant is made of zinc stearate.

3. The apparatus according to claim 1, wherein the secondary transfer roller is obtained by covering nitrile-butadiene rubber with a hydrin rubber tube and applying fluorine coating to a surface of the hydrin rubber tube and is formed at hardness of 30 degrees to 40 degrees (in Asker C hardness) and a diameter of 28 mm.

4. The apparatus according to claim 1, wherein the fur brush is made of polyethylene terephthalate and has thickness of 10 deniers, density of 300,000 per square inch, and a maximum diameter of 14 mm.

5. The apparatus according to claim 1, wherein a circumferential speed ratio between the secondary transfer roller and the fur brush is 1:0.46.

6. The apparatus according to claim 1, wherein a cut-in amount of the fur brush into the secondary transfer roller is 0.6 mm.

7. The apparatus according to claim 1, wherein a pressing amount of the blade against the secondary transfer roller is 1.1 g/mm to 1.5 g/mm and the cleaning blade is made of thermoplastic polyurethane and has hardness of 70 degrees (in JIS-A hardness).

8. The apparatus according to claim 1, wherein the lubricant is formed to be further spaced apart from the secondary transfer roller in the center than on both the end sides in the axial direction of the secondary transfer roller.

9. The apparatus according to claim 8, wherein the lubricant is formed by butting a pair of solid lubricants against each other in the center in the axial direction of the secondary transfer roller.

10. A secondary transfer unit comprising:

a secondary-transfer-unit supporting unit;

a secondary transfer roller that is supported by the secondary-transfer-unit supporting unit and comes into contact with an image bearing member and transfers a toner image onto a recording medium;

a secondary-transfer-roller housing unit that houses the secondary transfer roller;

a lubricant applying brush that comes into contact with the secondary transfer roller and applies a lubricant to the secondary transfer roller, a pressing amount of the lubricant at a center of the second transfer roller in an axial direction being set lower than that at both end sides of the second transfer roller in the axial direction;

a lubricant-applying-brush housing unit that houses the lubricant applying brush;

a solid lubricant that is housed in the lubricant-applying-brush housing unit and supplies the lubricant to the lubricant applying brush; and a lubricant holding member that elastically holds the solid lubricant.

11. The unit according to claim 10, wherein the pressing amount of the lubricant against the fur brush is 85 g/mm to 135 g/mm, and the lubricant is made of zinc stearate.

12. The unit according to claim 10, wherein the secondary transfer roller is obtained by covering nitrile-butadiene rubber with a hydrin rubber tube and applying fluorine coating to a surface of the hydrin rubber tube and is formed at hardness of 30 degrees to 40 degrees (in Asker C hardness) and a diameter of 28 mm.

13. The unit according to claim 10, wherein the fur brush is made of polyethylene terephthalate and has thickness of 10 deniers, density of 300,000 per square inch, and a maximum diameter of 14 mm.

14. The unit according to claim 10, wherein a circumferential speed ratio between the secondary transfer roller and the fur brush is 1:0.46.

15. The unit according to claim 10, wherein a cut-in amount of the fur brush into the secondary transfer roller is 0.6 mm.

16. The unit according to claim 10, wherein a pressing amount of the blade against the secondary transfer roller is 1.1 g/mm to 1.5 g/mm and the cleaning blade is made of thermoplastic polyurethane and has hardness of 70 degrees (in JIS-A hardness).

17. The unit according to claim 10, wherein the lubricant is formed to be further spaced apart from the secondary transfer roller in the center than on both the end sides in the axial direction of the secondary transfer roller.

* * * * *